United States Patent [19]

Hermelin

[11] Patent Number: 4,979,731

[45] Date of Patent: Dec. 25, 1990

[54] EXERCISE MACHINE AND METHOD

[76] Inventor: Victor M. Hermelin, 13547 Ladue Farm Rd., St. Louis, Mo. 63141

[21] Appl. No.: 878,180

[22] Filed: Jun. 25, 1986

Related U.S. Application Data

[60] Continuation-in-part of Ser. No. 728,856, Jul. 9, 1984, abandoned, which is a division of Ser. No. 429,688, Sep. 30, 1982, Pat. No. 4,512,571.

[51] Int. Cl.[5] ..... A63B 1/00; A63B 69/18

[52] U.S. Cl. ..... 272/70; 272/97

[58] Field of Search ..... 272/70, 72, 97, 126, 272/127, 134

[56] References Cited

U.S. PATENT DOCUMENTS 2,614,609 10/1952 Denison ..... 272/70

*Primary Examiner*—Stephen R. Crow

*Attorney, Agent, or Firm*—Polster, Polster and Lucchesi

[57] ABSTRACT

An exercise machine in which four interconnected movable stations are provided, two hand and two foot, one hand and one foot station being connected by a cable by way of pulleys for moving the stations in opposite directions in response to the exertion by the user of a preponderant force upon one of the stations, the other hand and foot station being connected by another cable by way of pulleys for moving the stations in opposite directions in response to the exertion by the user of a preponderant force upon one of the stations, and the two foot stations being connected to one another for moving the foot stations in opposite directions in response to the exertion by the user of a preponderant force upon one of the foot stations. A method of exercise is provided that includes pitting all four members, both arms and both legs, against one another to cause all four members to move separately but simultaneously, the members moving in response to the exertion of a preponderant force by a member or members.

3 Claims, 7 Drawing Sheets

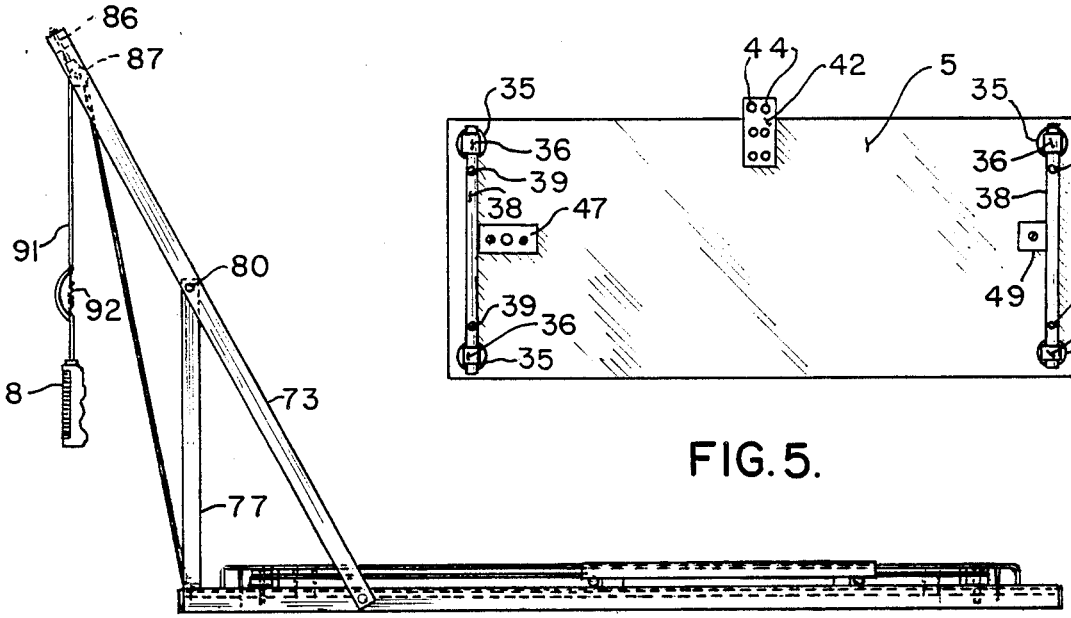
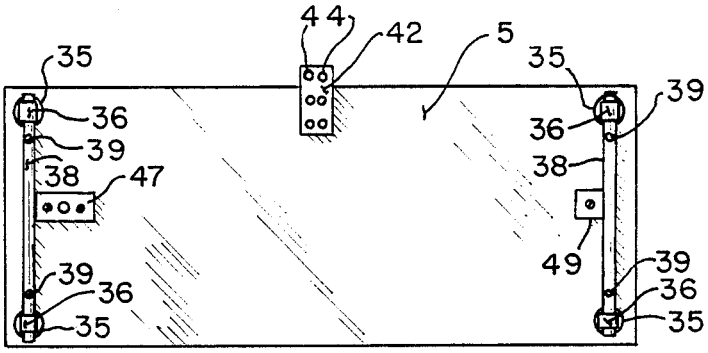
FIG. 5.
FIG. 2.
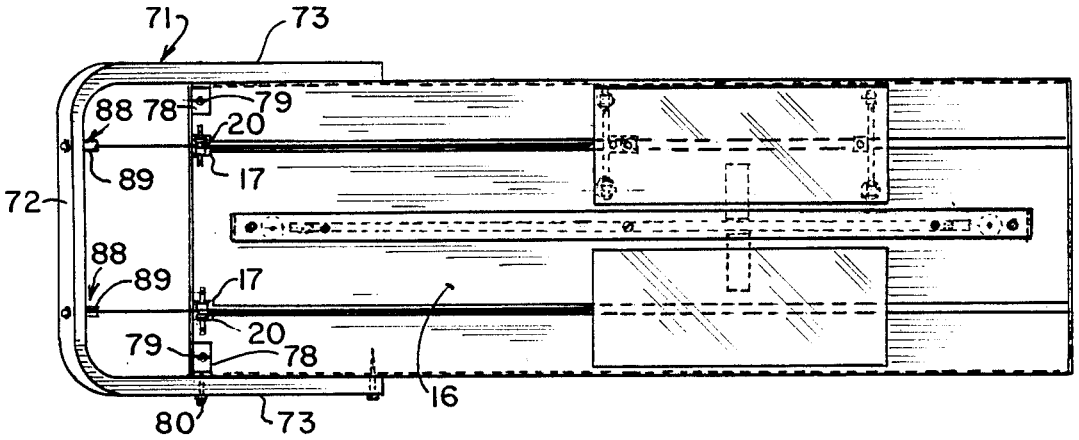
FIG. 3.
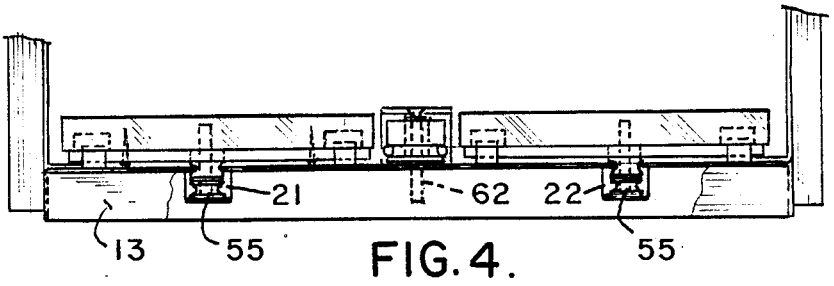
FIG. 4.

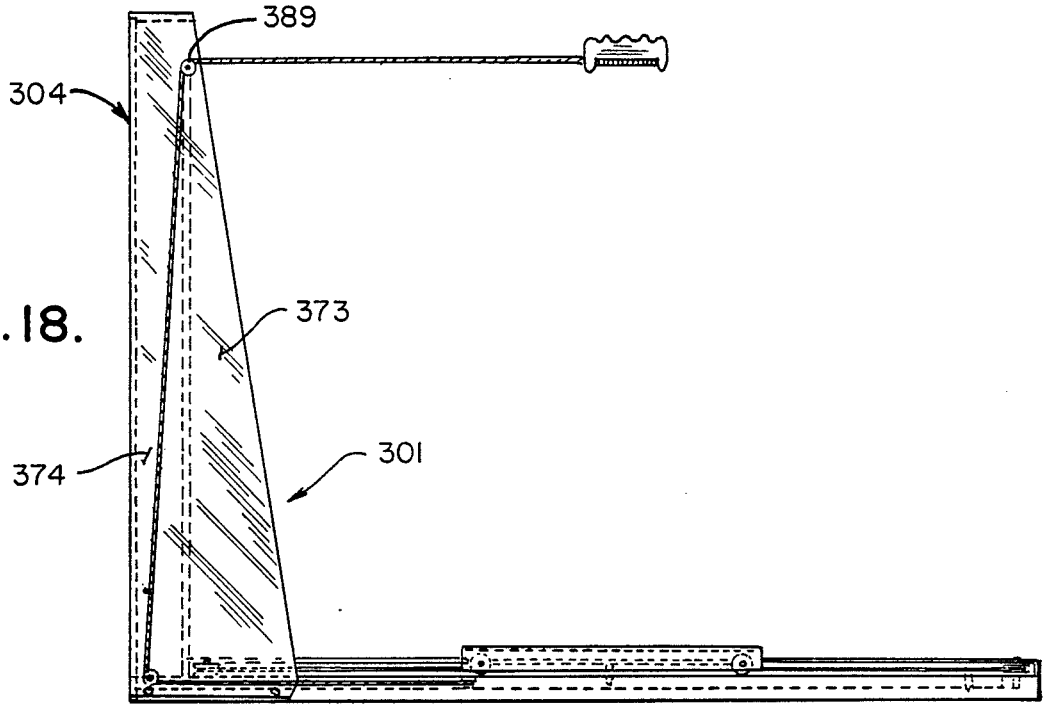
FIG. 18.
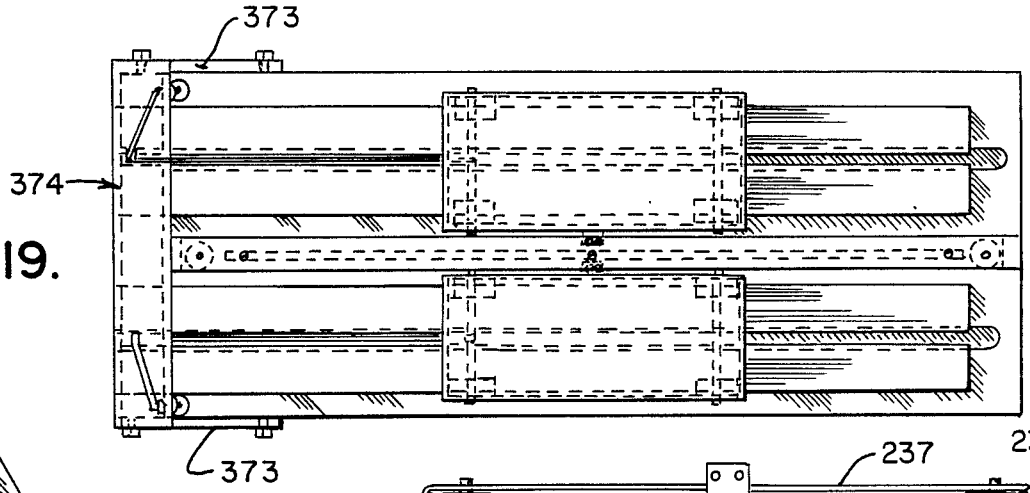
FIG. 19.
FIG. 20.
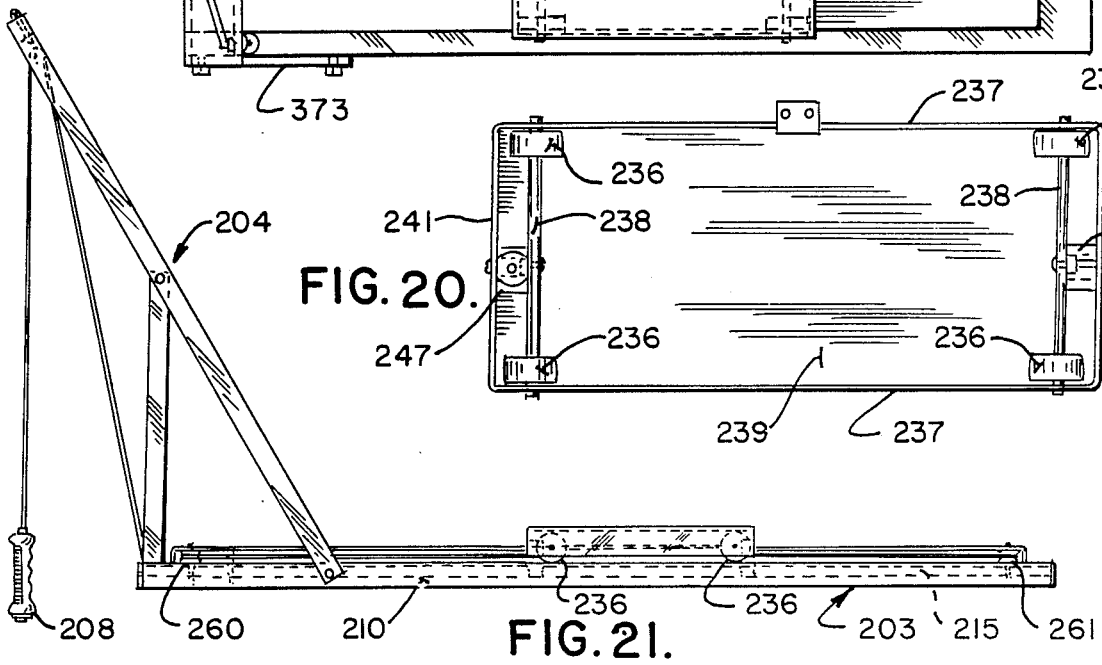
FIG. 21.

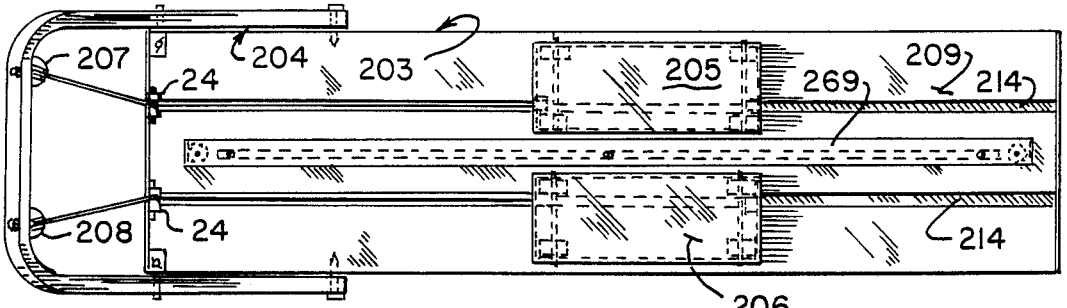
FIG. 22.
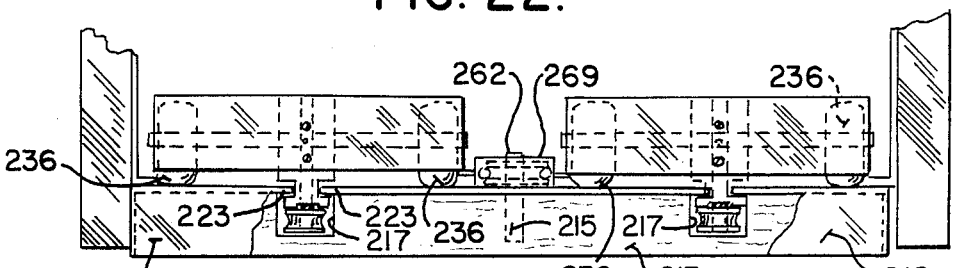
FIG. 23.
FIG. 26.
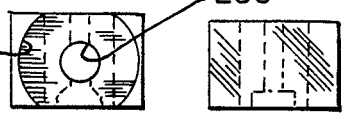
FIG. 24.
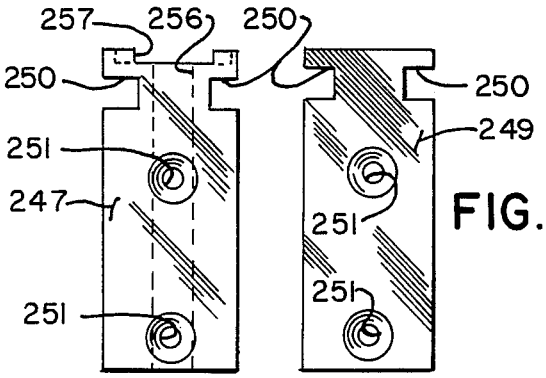
FIG. 27.
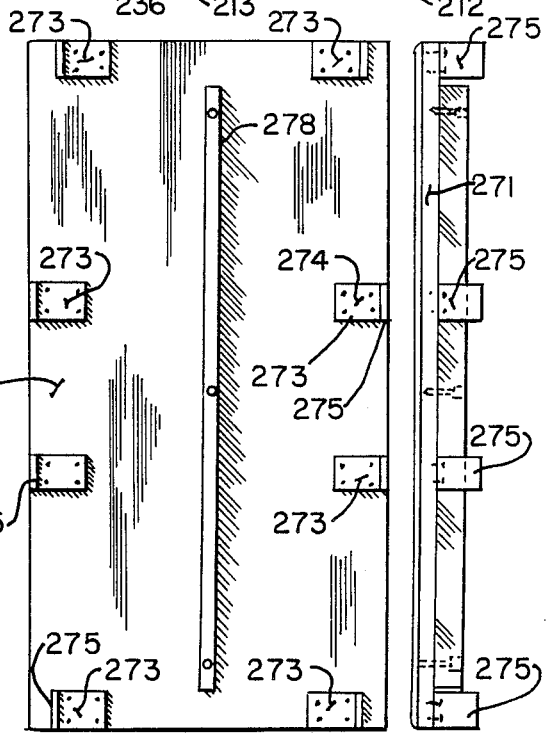
FIG. 25.
FIG. 28.
FIG. 29.
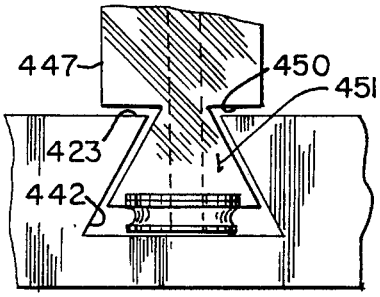
FIG. 30.
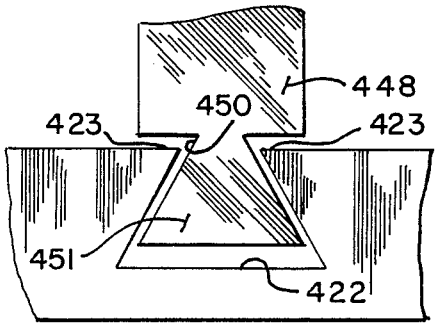
FIG. 31.

EXERCISE MACHINE AND METHOD

CROSS-REFERENCE TO RELATED APPLICATIONS

This application is a continuation in part of application Ser. No. 628,856, now abandoned, which is a divisional application of Ser. No. 429,688, now U.S. Pat. No. 4,512,571, issued Apr. 23, 1985.

BACKGROUND OF THE INVENTION

There is a widespread awareness of the need to exercise the human body rhythmically, for long enough periods of time, frequently and strenuously enough to increase respiration and pulse rate so that the cardiovascular and respiratory systems are stimulated, toned, strengthened and kept active and healthy. Iso-kinetic exercise that also tones and strengthens the peripheral muscle systems, subjects joints to many repeated movements, and structurally loads skeletal bones to keep them elastic and chemically stimulated so they do not deteriorate because of lack of demand, is ideal for these purposes.

Swimming, cycling, calisthenics and jogging are the most widespread forms of iso-kinetic activity. All exercise the cardiovascular system. Each, however, has limitations. In swimming, the midrif is not fully exercised because twisting and bending are minimized. Since we swim suspended in water, essentially free of gravity, bone structures are not stressed and tendons are not conditioned to withstand sudden strains. Cycling has the same limitations, and the additional limitation of almost no upper body exercise. Well designed calisthenic routines, such as aerobic dance if done non-stop and for sufficient time can work out the entire body very effectively. However, since they are not done against resistance, they do not increase strength to the extent that may be desirable. Jogging is simply a calisthenic essentially challenging the legs alone. It has the dangerous limitation of putting jarring strains on the foot, ankle, knee and hip structures.

There are stationary bikes in widespread use. There are good treadmills which permit very natural running. There are many other kinds of exercising equipment available using weights, springs, motors, clutches, etc., for resistance exercising, but these do not encourage continuous, prolonged, repetitious, rhythmic movements of the aerobic, iso-kinetic, cardiovascular respiratory system conditioning kind.

There have been many machines or arrangements of pulleys by which arms and legs have been linked to pull against one another. Gifford et al. U.S. Pat. No. 232,022 and Clease U.S. Pat. No. 821,783 are early examples. Gehri, U.S. Pat. No. 2,716,027, Fundom, U.S. Pat. No. 2,772,881, Macabet, U.S. Pat. No. 3,752,474, Codina, U.S. Pat. No. 3,979,114, Kupperman, U.S. Pat. No. 3,999,752, Flannery, U.S. Pat. No. 4,084,815, Hayes, U.S. Pat. No. 4,248,420, Flick, U.S. Pat. No. 3,582,069, Denison, U.S. Pat. No. 2,614,609, Swiss No. 574,743 (1974), Swiss No. 194,252 (1938), Swiss No. 200,296 (1938) and German No. 611,028 (1935) are other examples.

The machine of this invention can maximally load the cardiovascular and respiratory systems by providing interconnected coordinated movement of all four limbs at the same time, each providing resistance against which they all move individually. It permits many repetitions, continuously and rhythmically, including bending, stretching, twisting, balance and coordination of movements. The method of use of the machine of this invention, pitting all four of the members and torso against one another in continuous motion, is a source of overload which provides continuous, in-motion self regulated variable and progressive resistance. The construction of this machine also permits the use of the machine to exercise one limb against another, and sitting and reclining exercises as well, in addition to its primary use.

One of the objects of this invention is to provide a machine by which one can exercise the body iso-kinetically with self imposed resistance, increasing as the body strengthens.

Another object is to provide such a machine which is simple, rugged, dependable, and economical.

Another of the objects of this invention is to provide a method of exercising the body iso-kinetically with self-imposed resistance, increasing as the body strengthens.

Other objects will become apparent to those skilled in the art in the light of the following description and accompanying drawing.

SUMMARY OF THE INVENTION

In accordance with this invention, generally stated, in an exercise machine in which stations for the four members, arms and legs, are interconnected by cables in such a way that when one station is moved, all are forced to move at the same time, individually, foot treadles constituting one set of stations are mounted on a frame provided with center channels defined in part by facing lips. The channels extend longitudinally of the frame. Treadle guide means under the treadles are movably mounted in said channels, the guide means having a groove complementary to and receiving the lips. The hand stations and the treadles are connected by flexible cables in such a way as to provide that the travel of each hand station is double that of the travel of its connected foot station. In the preferred embodiment, a cable has a hand station at one end, tends through a swivel pulley mounted on a U-shaped yoke, passes around a sheave mounted in the frame, around a sheave mounted on a shaft on which one of the treadle guide means is mounted, and is secured at its other end to an end plate on the frame. In the preferred embodiment, the yoke extends diagonally in a direction away from the frame in an upward direction, which adds flexibility to the use of the apparatus. If a member is in place at each of the stations, all of the members are forced to move against the resistance of the others, the right arm and leg stations in opposite directions from one another and the left arm and leg stations in opposite directions from one another and from the right arm and leg stations. Resistance to movement is accomplished by pulling with one or more members against a superior force exerted by one or more other members.

BRIEF DESCRIPTION OF THE DRAWINGS

In the drawing.

FIG. 2 is a view in side elevation;

FIG. 3 is a view in top plan;

FIG. 4 is a fragmentary view in end elevation, partly broken away, of the yoke end of the machine;

FIG. 5 is a bottom plan view of a treadle;

FIG. 18 is a view in side elevation of still another embodiment of machine of this invention;

FIG. 19 is a top plan view of the machine shown in FIG. 18;

FIG. 20 is an enlarged bottom plan view of a treadle used with the embodiments of machine shown in FIGS. 18 through 33;

FIG. 21 is a view in side elevation of still another embodiment of machine of this invention;

FIG. 22 is a top plan view of a machine shown in FIG. 21;

FIG. 23 is a view in end elevation, partly broken away, and viewed from left to right of the machine shown in FIGS. 21 and 22;

FIG. 24 is a top plan view (in the orientation shown in FIGS. 24 and 25) of a rear treadle guide;

FIG. 25 is a view in side elevation of rear treadle guide;

FIG. 26 is a top plan view of a front treadle guide (in the orientation shown in FIGS. 26 and 27);

FIG. 27 is a view in side elevation of a front treadle guide;

FIG. 28 is a bottom plan view of a cover member-bench;

FIG. 29 is a view in side elevation of the cover-bench shown in FIG. 28;

FIG. 30 is a fragmentary view in front elevation of another embodiment of front treadle guide and channel;

FIG. 31 is a fragmentary view in front elevation of another embodiment of rear treadle guide and channel corresponding to the front treadle guide shown in FIG. 30;

DESCRIPTION OF THE PREFERRED EMBODIMENTS

Figures 1, 6, 7, 8, 9, 10, 11, 12, 13, 14, 15:
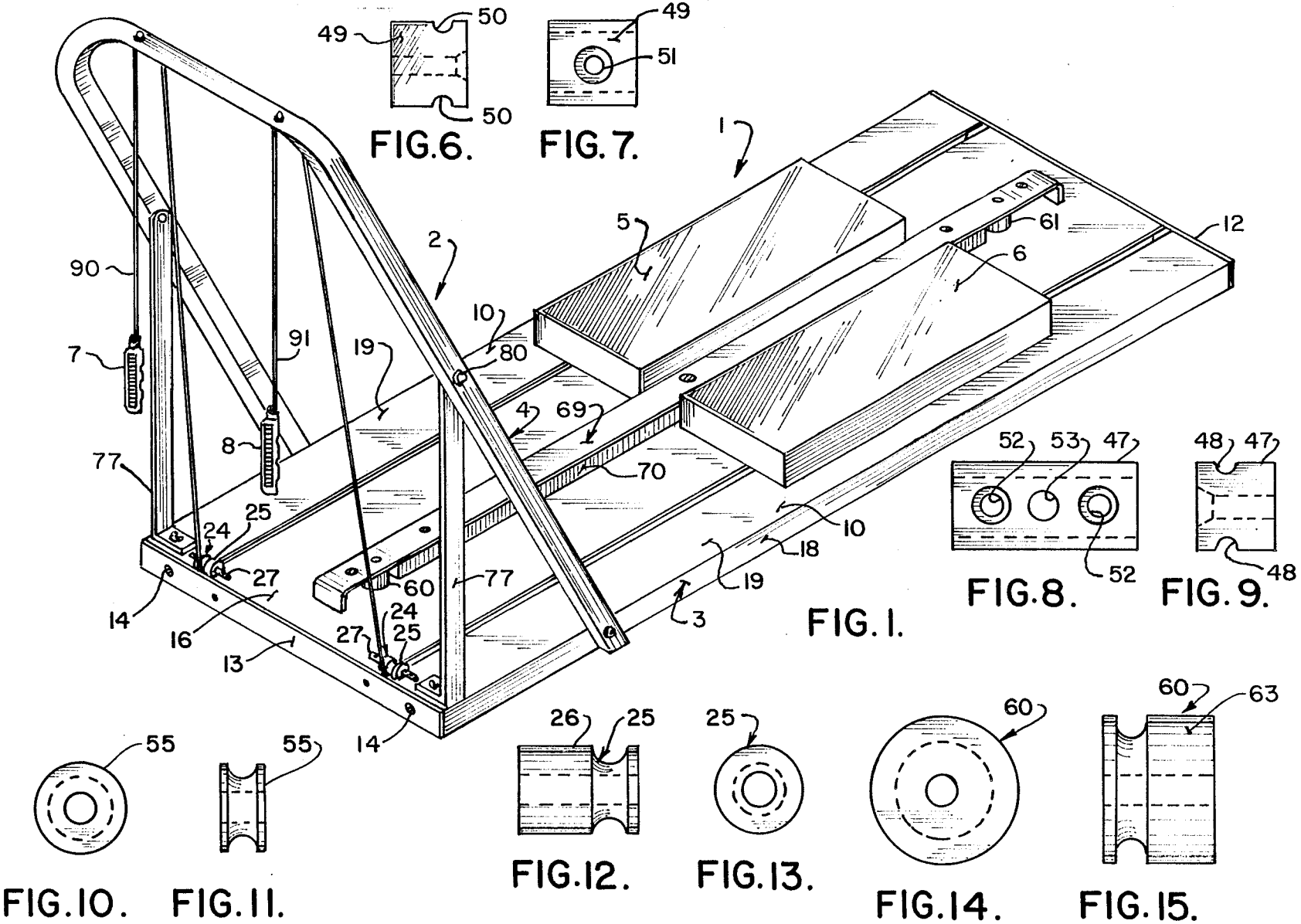
FIG. 1 is a view in perspective of one embodiment of exercise machine of this invention.
FIG. 6 is a detail view in side elevation of a rear treadle guide.
FIG. 7 is a top plan view of the rear treadle guide of FIG. 6.
FIG. 8 is a top plan view of a front treadle guide.
FIG. 9 is a view in side elevation of the treadle guide of FIG. 8.
FIG. 10 is a view in side elevation of a treadle cable sheave.
FIG. 11 is a view in edge elevation of the treadle cable sheave of FIG. 10.
FIG. 12 is a view in side elevation of a base-mounted cable sheave.
FIG. 13 is a view in end elevation of the sheave of FIG. 12.
FIG. 14 is a view in end elevation of a base mounted treadle synchronize system sheave.
FIG. 15 is a view in side elevation of the sheave of FIG. 14.

Referring now to FIGS. 1 through 16 of the drawing for one illustrative embodiment of exercise machine of this invention, reference numeral 1 indicates a complete machine. The machine 1 includes a frame 2, made up of a base 3 and a pulley support assembly 4, a right foot station in the form of treadle 5, a left foot station in the form of a treadle 6, a right hand station in the form of a hand grip 7, and a left hand station in the form of a hand grip 8. The treadles 5 and 6 are in all respects mirror images of one another. The base 3 in this embodiment is made of a thick slab of particle board.

The base 3 has metal side rail covers 10, rear end plate 12, and front end plate 13. The front end plate 13 has mounting holes through which screws extend to mount the plate to the base, and cable holes 14. A metal center base cover 16 has notches 17 at its front end.

The side rail covers 10 are mirror images of one another, and are made of heavy guage metal. Each has a skirt 18 and a rail-web 19. The rail-webs 19 also have notches 20, mirror images of the notches 17 in the center base cover. The base 3 has a right channel 21 and a left channel 22, opening through the top surface of the base, parallel with one another and parallel with the long sides of the base. The side cover rail-web and the long side edges of the center base cover 16 are spaced from one another and positioned symmetrically with respect to the channels 21 and 22. The edges of the rail-webs and center base cover extend beyond the side walls defining the channels 21 and 22, to serve as guide and restraining lips 23, as shown most clearly in FIG. 4. The base channels 21 and 22 extend, in this embodiment, through the full length of the base, being closed at their ends by the end plates 12 and 13. The notches 17 and 20 in effect cut away the lips 23, to permit the mounting of a cable pulley 24. The cable pulley 24 consists of a sheave 25, which has a bearing-hub part 26, rotatably mounted on a shaft 27 secured to the base by screws or the like, as best shown in FIG. 1.

Figure 16:
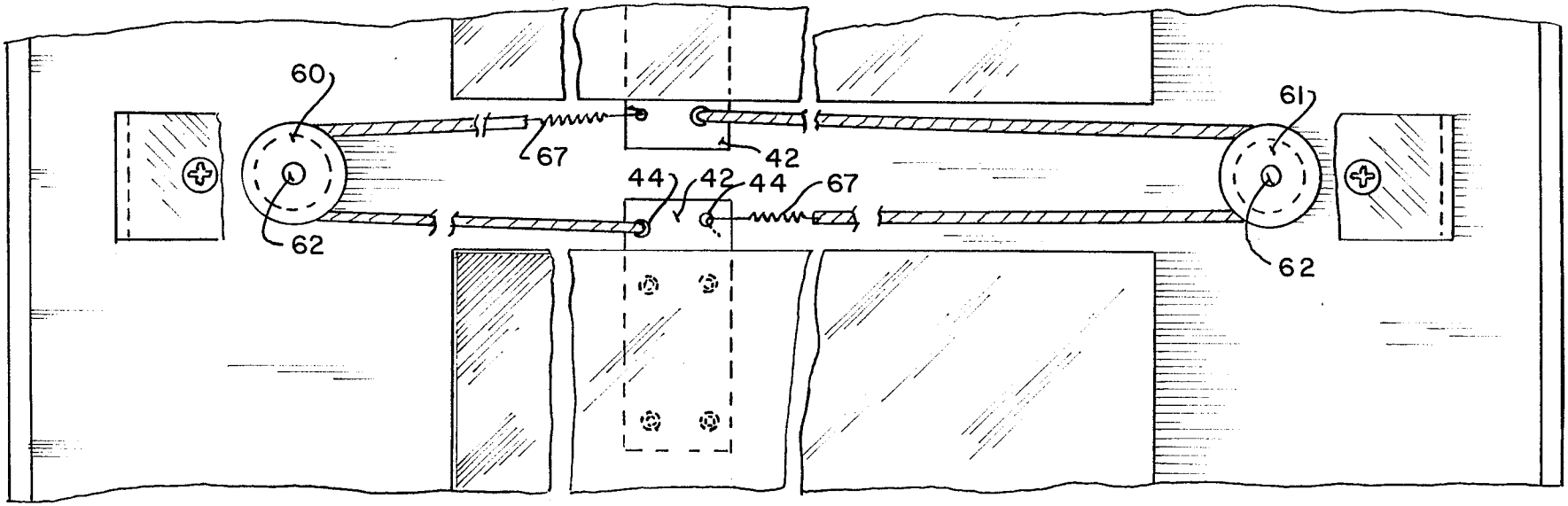
FIG. 16 is a fragmentary plan view of the base of the frame of the machine, with parts broken away to show the treadle synchronize system.

In this embodiment, the treadles 5 and 6 are mounted on rollers 36 that roll on the rail-webs 19 and center base cover 16. The rollers 36 are mounted on treadle roller shafts 38, that are mounted to the underside of the treadles by means of screws 39. In order to accommodate the rollers, the treadles have appropriately located treadle roller wells 35 in their undersides. The treadles also have mounted on their undersides treadle synchronizing fastening plates 42 which project from beyond facing edges of the treadles, and are provided with cable holes 44, as shown in FIGS. 5 and 16.

An important feature of this invention is the provision of treadle center guides. In this embodiment, each of the treadles has a front treadle center guide 47 and a rear treadle center guide 49. The rear treadle guide 49 is, in this embodiment, a cube of high density polyethylene or the like, with parallel grooves 50 in opposite vertical sides, into which the lips 23 extend, and, at right angles to the channels 50, a screw receiving hole 51, as shown particularly in FIGS. 6 and 7.

In this embodiment, the front treadle center guide 47 is rectangular in plan, as shown in FIG. 8, with channels 48 in opposite vertical long sides, as shown in FIG. 9, which, like the channels 50, receive the lips 23, as shown in FIG. 4. There are three holes in the long sides perpendicular to the sides in which the channels 48 are, two screw holes 52 and one front treadle roller shaft hole 53.

A treadle cable roller shaft 54 is securely mounted in the hole 53, projecting downwardly from the treadles into one of the channels 21 and 22, and carrying at its lower end a center treadle cable sheave 55. The treadle cable sheave 55 is rotatably mounted on the shaft 54, and is spaced from and centered with respect to the side walls of the channels 21 and 22, as shown particularly in FIG. 4.

Front treadle synchronizing sheave 60 and rear treadle synchronizing sheave 61 are rotatably mounted on shafts 62 mounted in and projecting upwardly from the base 3 on a line parallel to and centered between the channels 21 and 22. The front and rear sheaves 60 and 61 are identical. Each has a heavy hub-bearing section 63. As shown particularly in FIGS. 4 and 16, synchronizing cables 65 are mounted at one end in a hole 44 in the plate 42, extend around a treadle synchronizing sheave, and are fastened, in this embodiment, to a helical tension spring 67, thence to the other plate 42, the spring 67 hooking into the other of the holes 44 all as shown most clearly in FIG. 16. A sychronizing assembly cover guard 69 is supported through its central section by a divider strip 70 mounted on base 3 along the center line of the center base cover 8, as shown in FIGS. 1, 2 and 3.

The pulley support assembly 4 at the front end of the base includes a pulley assembly yoke 71, inverted U-shaped in plan, with legs 73, mounted at their lower ends to the base, and an integral cross member 72. The yoke is supported intermediate the ends of the legs, by stanchions 77, each with a foot 78 projecting at right angles, through which a screw 79 passes into the base. The stanchion is bolted near its top to a leg of the yoke by a bolt 80. The cross member-support 72 has holes through it to receive shafts 86 on which blocks 87 of swivel pulleys 88 are swivelly mounted. In each block, a sheave 89 is journaled on the usual pin carried by the block 87. One of the swivel pulleys 88 is aligned with the channel 21 and the other is aligned with the channel 22.

A right cable 90, in this embodiment a rope, tends around the right one of the sheaves 89, beneath and around the aligned sheave 20, through the channel 21, around the front treadle sheave 55 of the treadle 5, back through the same channel, to the front end plate 13, where it is secured, as by passing the free end through a hole 14 and knotting it. The rope 91 goes through the left sheave 89, beneath and around the aligned sheave 20, through the channel 22, around the treadle sheave of the treadle 6 and back to the end plate 13.

At the free end of the rope hanging from the pulley 88, the rope, in this embodiment, intermediate its outermost end and the pulley 88, is connected, with some slack, to a helical tension spring 92. The outermost end of the rope 90 is connected to the hand grip 7 and the rope 91 is connected to the handle 8.

Figure 17:
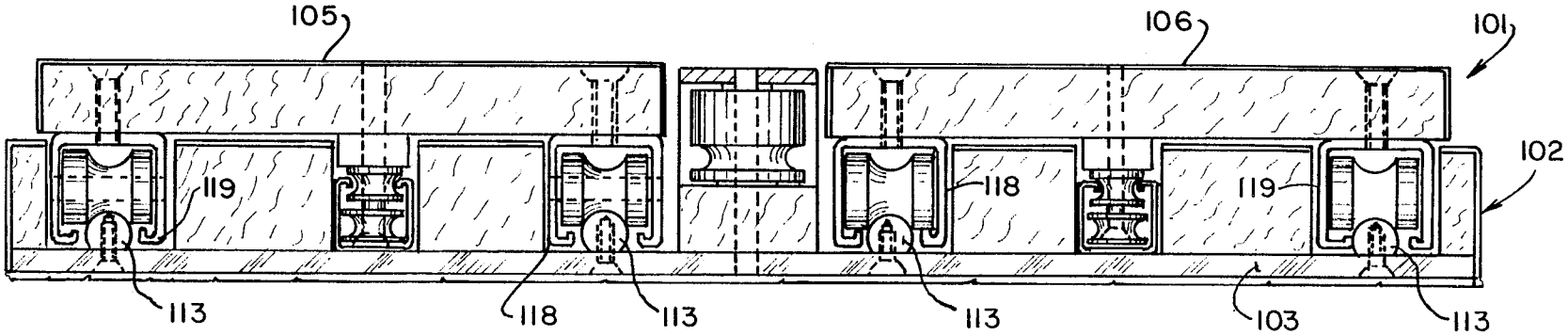
FIG. 17 is a view in end elevation, with end plates removed for clarity, and partly in section, of another embodiment of machine of this invention.
Figure 32:
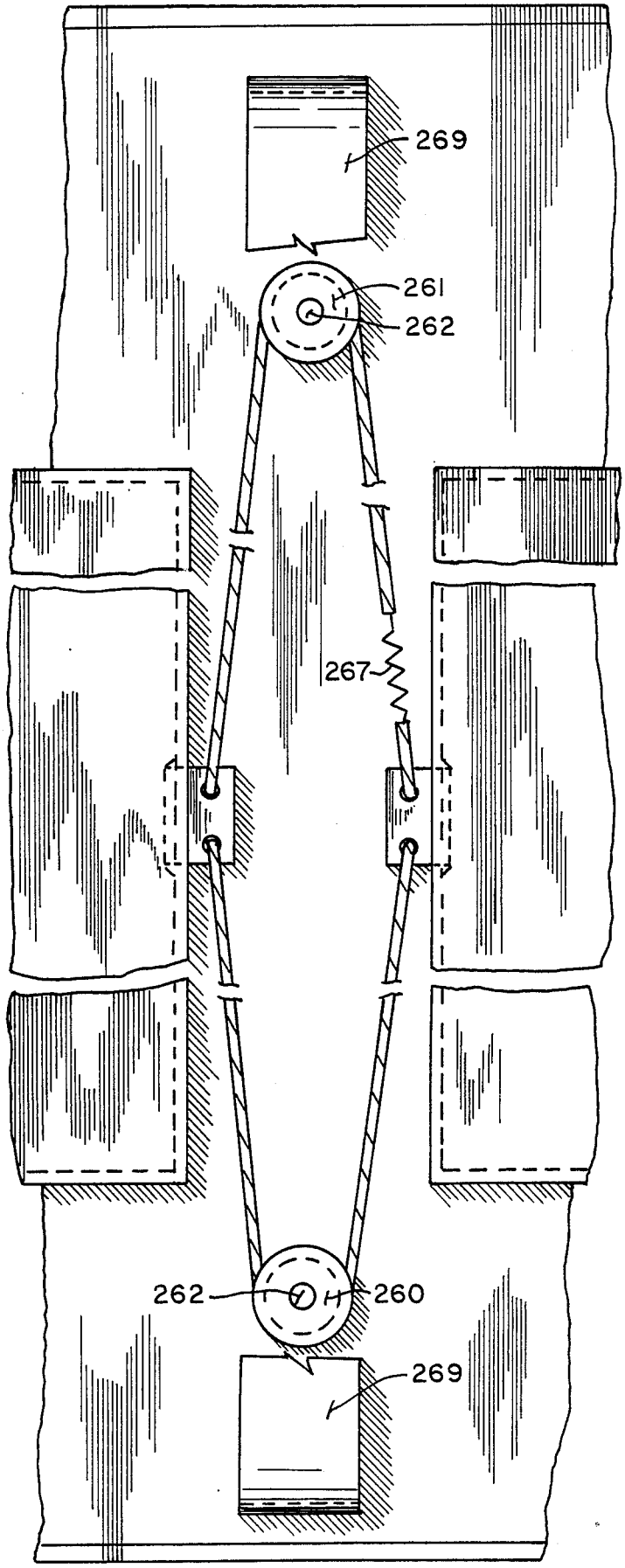
FIG. 32 is a fragmentary, somewhat diagrammatic tape-plan view of a treadle synchronizing system.

Referring now to FIG. 17 for another embodiment of exercise device of this invention, a machine 101 includes a frame 102 with a base 103, a right treadle 105 and a left treadle 106. In this embodiment, treadle rails 113, bolted to the base 103, extend lengthwise of the base. Treadle rollers 115, with annular grooves shaped complementarily to the rails 113, are journaled on shafts 117 mounted in side walls of inboard channels 118 and outboard channels 119. The channels 118 and 119 have inwardly extending lips, and may be of the type available commercially under the trademark Unistrut. A treadle center guide, in the form of a Unistrut channel 121 extends substantially the length of the base 103 beneath each treadle. In this embodiment, front and rear treadle center guide wheels 123, corresponding in function and position to the front and rear treadle guides 47 and 49 are provided. However, the guide wheels 123 are revolvably mounted on shafts, and are provided with annular grooves into which lips 122 of the channel 121 project. The shaft on which the front center guide wheel is journaled also carries a cable sheave 124, corresponding in size, shape and function to the treadle sheave 55 of the first embodiment. The rest of the frame and treadle construction will be obvious from FIG. 17. A pulley support assembly like that of the embodiment shown in FIGS. 1 through 16 can be employed.

Referring now to FIGS. 20 through 29, and 32, for another illustrative embodiment of exercise machine of this invention, reference numeral 202 indicates a frame made up of a base 203 and a pulley support assembly 204, a right foot station in the form of a treadle 205, a left foot station in the form of a treadle 206, a right hand station in the form of a hand grip 207 and a left hand station in the form of a hand grip 208. The treadles 205 and 206 are in all respects mirror images of one another. The base 203 in this embodiment is made like the base 3 of the first embodiment, with a bed of particle board 215, and what, in the aggregate, amounts to an open bottomed box of heavy gauge aluminum or the like with a top wall 209, made up of side rail covers and a center base cover just as in the first embodiment described, side walls 210, and rear end wall 212, and a front wall 213. By virtue of the spacing of the side rail covers and the center base cover, the top wall 209 is in effect slotted above the channels in the bed 215, just as in the first embodiment described. The front wall 213 is cut away to form openings below and symmetrical with respect to the slots 214. The edges defining the slots also define lips with respect to the openings in the front wall and channels 217, extending from each side edge of the opening at its top, like lips 23 of the embodiment first described. As in the first embodiment, cable pulleys 24 are provided.

In this embodiment, the treadles 205 and 206 are made of metal, such as heavy guage aluminum, in the form of an open bottomed box, elongatedly rectangular in plan. The treadles have side walls 237 a rear end wall 240 and front end wall 241. The treadles are mounted on rubber wheels 236, revolvably mounted on shafts 238 mounted in and extending through aligned holes in side walls 237. They are held against shifting laterally by screws or rivets associated with front and rear treadle guides 247 and 249 respectively. The treadle guides are made of high density polyethylene or the like. Both have parallel grooves 250 in opposite vertical sides into which the lips 223 extend. The treadle guides 247 and 249 differ from the guides 47 and 49 in being elongated, and having screw receiving holes 251 extending parallel to the direction of the grooves 250. The front treadle guide 247 has a passage 256 through its long axis, and its lower end surface, immediately beyond the groove 250 is counterbored to form a seat 257.

A treadle cable roller shaft corresponding to the shaft 54 of the first embodiment is securely mounted in the passage 256, projecting downwardly as shown in FIG. 23. A treadle cable sheave 255 is rotatably mounted on the shaft, and is spaced from and centered with respect to the side walls of the channel 217. In this embodiment, the sheave 55 is provided with a circular boss on its upper surface that seats rotatably in the seat 257, to inhibit accidental wedging of a cable between the sheave and the treadle guide. The front and rear treadle guides 247 and 249 are mounted on the inside surfaces of the front and rear walls 241 and 240 respectively of the treadles, as shown particularly in FIG. 20.

A front treadle synchronizing sheave 260 and a rear treadle synchronizing sheave 261 are rotatably mounted on shafts mounted at one end in a passage in the bed and projecting upwardly from the upper surface 209 of the base 203, along the longitudinal center line of the base. The upper ends of the shafts 262 extend through holes in a cover guard 269 secured to the upper surface 209 at its ends. The construction and operation of the treadle synchronizing system of this embodiment are in principle and operation the same as those of the synchronizing system of the embodiment first described. In the system shown in FIG. 32, a single spring 267 is shown, instead of two springs, but one is sufficient.

Similarly, the pulley support assembly 204 is essentially the same as the support assembly 4. In this embodiment, the swivel pulleys are spaced apart slightly more than the sheaves 24, so that the cable tends covergently from the blocks attached to the yoke to the sheave of the pulley 24.

Referring to FIGS. 28 and 29, a cover-bench 270 is shown, consisting of a platform member 271, which may be and preferably is padded on its upper surface, and support brackets 273 each with a mounting plate 274 and a leg 275, so spaced and arranged as to engage the floor and support the platform 270 above the treadles when the cover-bench is placed, with the legs 275 facing the base 203, over the base. A reinforcing and centering bar 278 is centered lengthwise of the platform on its undersurface, is aligned with the assembly cover guard 269, and extends within the space between the treadles. In this embodiment especially, it is easy to provide for the folding flat of the support assembly, by using wing nuts or the like to mount the legs of the U-frame and pivotally mounting the stanchions, and this is the preferred form.

Figure 33:
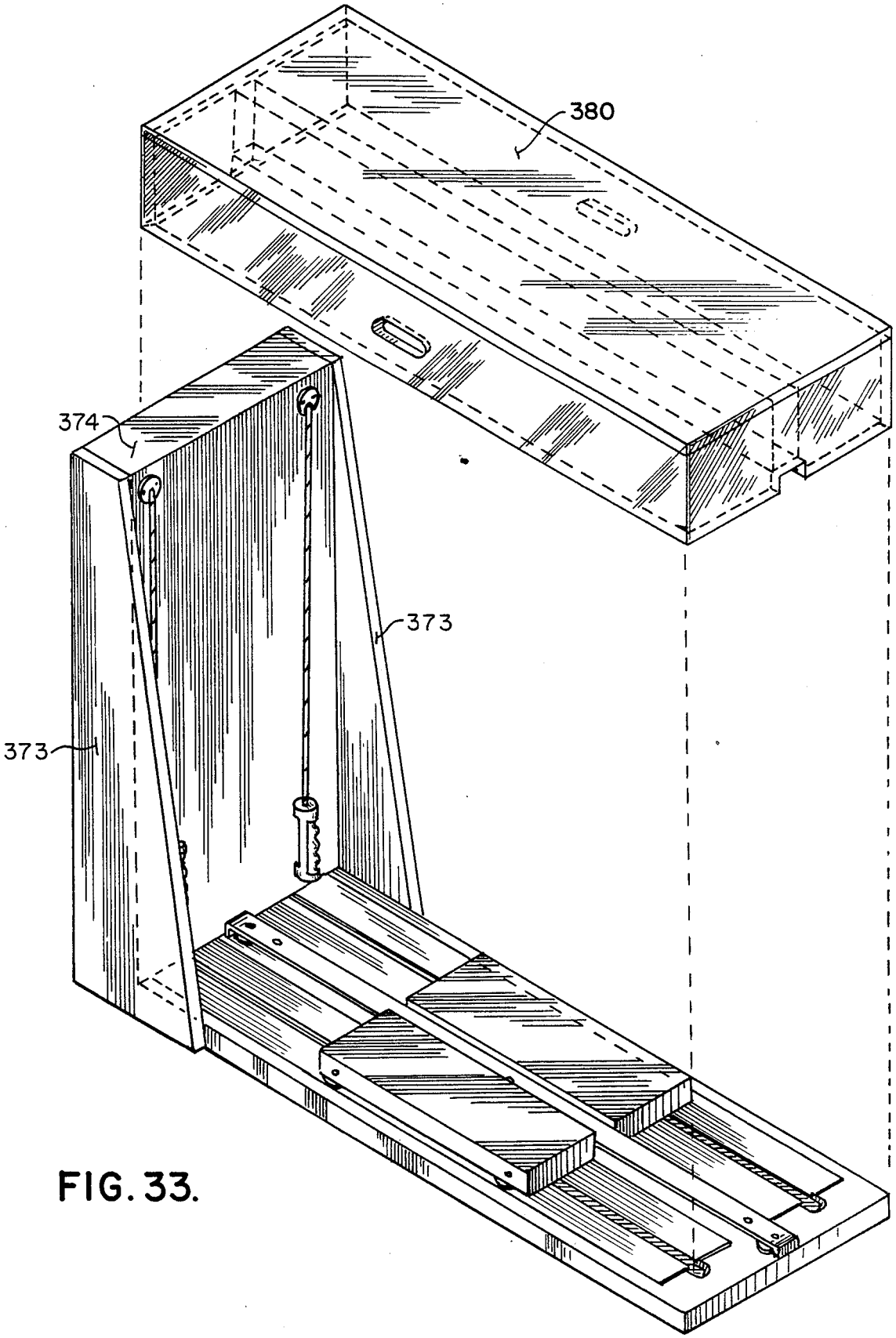
FIG. 33 is an expanded view in perspective of yet another embodiment of machine of this invention.

Referring now to FIGS. 18, 19 and 33 for still another embodiment, reference numeral 301 represents the entire machine. The treadle and synchronizing system of this embodiment are substantially identical with those of the embodiment shown in FIGS. 20 through 27. However, the bed of the base is covered with formica, cut away to permit the inlaying of metal treadle runner strips as shown particularly in FIG. 19. In the machine 301, a modified pulley support assembly 304 is provided. The pulley support assembly 304 includes side gusset plates 373 preferably of cabinet grade wood, and a vertically oriented box-like stand 374. In this embodiment, sheaves 389 are mounted for rotation, but not for swiveling, inside the stand 374, as shown in FIG. 18. The stand 374 has holes, positioned appropriately to permit the cables to tend around the sheaves 389, and suitable passages at its lower end to accommodate the sheaves 24 and to permit the cables to tend around the sheaves of the front treadle guide. As shown in FIGS. 18 and 19, the cables actually tend toward the user from the sheaves 24 to the sheaves 389. In this embodiment, a cover-bench 380 is provided, also, like the gussets 373 and the stand 374, of cabinet grade wood. The construction and the placement of the cover-bench 380 will be evident from the view shown in FIG. 33. As in the case of the cover 270, a central partition is provided, both for strength and to fit between the treadles, thus inhibiting lateral displacement. The cover-bench 380 can also be padded and upholstered. This embodiment provides a furniture-grade piece that can be set up permanently in a home or office.

The cover-benches 370 and 380 not only serve the function of protecting the device and providing a pleasing appearance, but provide additional modes of exercise as well with the machine of this invention.

Referring now to FIGS. 30 and 31, a front treadle guide 447 and a rear treadle guide 448 are shown, to illustrate that other forms of groove and lip arrangement can be used. In this embodiment, a channel 422 in the form of an open topped truncated cone in elevation is provided in the base, lips 423 being defined by the areas between the walls defining the sides of the channel 422 and the top surface of a base. The treadle guides 447 and 448 are provided at their lower ends with a dove tailed tenon 451 shaped complementarily to the channel 422, and defining channels 450 into which the lips 423 extend.

The term "cable" is used herein to encompass any suitable flexible member that is substantially inelastic in the lengthwise direction, such as a cotton or other fiber line or rope, plastic cord, such as nylon, polypropylene, polyethylene or the like, or even metal. The treadle synchronizing cable can be a belt that can be of any well known type, e.g. reinforced rubber, V, fiber, plastic, or metal. In the latter case, it can take the form of chain such as bicycle chain, in which case the sheaves can take the form of sprockets. By virtue of this arrangement, when one of the treadles moves toward the upright, the other moves away from the upright, and vice versa.

It can be seen that with the arrangement of both embodiments, the force exerted when a hand grip is pulled back is doubled on the corresponding treadle and the travel of the foot station is only half that of the hand grip. This accords with normal relative strength and degree of movement of those members. When a hand grip is pulled back, its corresponding treadle moves forward, causing its motion to be transmitted through the cable 65 to move the other treadle backward and its corresponding hand grip to move forward. If, by virtue of force exerted by the user's leg, a treadle is moved backward, the corresponding hand grip is moved forward, and the other treadle and handgrip are moved in the opposite directions.

The arrangement of this machine provides great versatility. If it is desired to exercise only the arms, they can be used to pull against one another without any alteration of the machine or the cable, because force applied to one hand grip is transmitted, by way of the treadle belt, to the other. Similarly, if the legs are to be exercised without the arms, the cable 65 will transmit force from one leg against the other, regardless of the fact that the hand grips are hanging loose. Three members can be exercised, for the same reasons. The legs can be exercised without applying the stress on the joints that would be produced by standing on the treadles, by sitting on a bench such as the cover-benches 270 and 280, and putting the feet on the treadles or sitting and putting the feet in the hand grips, or by lying down on the side opposite the base and putting the feet in the hand grips. One leg and one arm can be exercised by putting a foot in one hand grip, a hand in the other, to provide an unusual coordinative exercise. Other specialized arrangements utilizing the machine can be used for special physical therapy exercises patterned to the disability of specific patients.

The important part of the operation of the machine is that each member is moved individually, so that one can exert the desired resistance with any and all of the members, from a standing or sitting position, and that one can use any two or three members against one another as well, if that is desired.

Merely by way of illustration, the frame base can be rectangular, 4' by 16", and the cross-member 72, 3' from floor level. The treadles can be 7" wide, and 16" long. The treadle rollers 36 can be made of high density polyethylene and can be ½" in diameter. The treadle rollers 236 can be made of relatively soft rubber and be about 2" in diameter.

Numerous variations in the construction of the device of this invention, within the scope of the appended claims, will occur to those skilled in the art in the light of the foregoing disclosure. By way of example, and not of limitation, although a pulley or sheave and belt arrangement is preferred because of its simplicity, a mechanical interconnected lever, a slide, or an arrangement of central pinion and racks carried by the treadles could be used. The frame base can be made of tubing or the yoke of angle iron rather than the square tubing of the preferred embodiment, or the entire frame can be made of wood, for example. The rollers and races can be of any desired sort, as for example, roller bearing-equipped wheels. The pulleys can be constituted by rings of glass or slick-surfaced plastic, although it is desirable to keep the friction of the cable through the pulleys of whatever nature as low as possible, so that the counter-forces are substantially all produced by the members being exercised, not the mechanical resistance of the machine. Other ratios can be provided by using other combinations of pulleys. Various attachments, such as boots attached to the treadles or ski poles hinged to the frame and connected to the hand-grip cables, or a fold-up bench, can be provided, and the yoke can be hinged and held securely in its upright position with a releasable brace or other holding means to permit easy folding of the upright over the base for storage of the machine. The front or back of the base can be elevated with respect to the other end, in which case the effect on the members when all four are being used in the standard way as shown in FIG. 4 is negligible, but when only two are being used, is augmented in one direction and diminished in the other by the force of gravity. This is not a preferred arrangement, for the reasons discussed above, but illustrates the versatility of the device. Electronic monitoring devices for counting movements or for monitoring the pulse of the user can be provided. These variations are merely illustrative.

I claim:

1. A method of using a machine having a frame and four movable stations, two hand stations being adapted to accommodate the hands, and two, foot stations adapted to accommodate the feet of a human user, a right one of said hand and a right one of said foot stations being on a right long side of said frame, and a left one of said hand and a left one of said foot stations being on a left long side of said frame, means for interconnecting said stations so as to move the right foot station forward and the left hand station forward and the left foot station toward a position behind the user when the right hand station is moved toward a position behind the user, and to move the left foot station forward and the right hand station forward and the right foot station toward a position behind the user when the left hand station is moved toward a position behind the user, and means, as cables each connected at one end to one of said hand stations, tending around a running pulley mounted on a corresponding foot station and fixedly connected at its other end to said frame, operable physically by said user for causing the hand stations to move on the order of double the distance moved by said foot stations, for exercising a human user, said method comprising pulling on a first one of said hand stations with a force greater than on the other of said hand stations and sufficient to cause said one of said hand stations to move toward a position behind said user and the corresponding foot station to move forward a distance on the order of half the travel of the hand station, and thereafter pulling on the other of said hand stations with a force greater than on the first of said hand stations and sufficient to cause said other of said hand stations to move toward a position behind said user and the corresponding foot station to move forward a distance on the order of half the travel of the hand stations, said hands exerting only a pulling force, and no pushing force.

2. A method of exercising the body of a human user having two arms, each with a hand, and two legs, each with a foot, using a machine having a frame and four movable stations, two hand stations being adapted to accommodate the hands, and two foot stations adapted to accommodate the feet of the human user, a right one of said hand and a right one of said foot stations being on a right long side of said frame, and a left one of said hand and a left one of said foot stations being on a left long side of said frame, means for interconnecting said stations so as to move the right foot station forward and the left hand station forward and the left foot station toward a position behind the user when the right hand station is moved toward a position behind the user, and to move the left foot station forward and the right hand station forward and the right foot station toward a position behind the user when the left hand station is moved toward a position behind the user, and means, such as cables each connected at one end to one of said hand stations, tending around a running pulley mounted on a corresponding foot station and fixedly connected at its other end to said frame, operable physically by said user for causing the hand stations to move on the order of double the distance moved by said foot stations, said method comprising exerting a preponderant force on one station in a direction toward a place behind the user to exert only a pulling force against either of the arms of the user, and moving said arms through a distance on the order of double the distance moved by said legs.

3. The method of claim 2 including moving said hands in an arcuate path.

* * * * *